US006230368B1

(12) United States Patent
Patelli et al.

(10) Patent No.: US 6,230,368 B1
(45) Date of Patent: May 15, 2001

(54) DEVICE AND PROCESS FOR CLEANING WEB-SQUEEZING ROLLERS AT OUTPUT FROM A CARDING MACHINE

(75) Inventors: Silvano Patelli; Massimo Galli; Giovanni Battista Pasini, all of Palazzolo Sull'Oglio (IT)

(73) Assignee: Marzoli S.p.A., Palazzolo Sull' Oglio ( * ) Notice: Subject to any disclaimer, the term of this patent is extended or adjusted under 35 U.S.C. 154(b) by 0 days.

(21) Appl. No.: 09/579,132

(22) Filed: May 30, 2000

(30) Foreign Application Priority Data

May 28, 1999 (IT) ..... MI99A1189

(51) Int. Cl.[7] ..... D01G 15/76

(52) U.S. Cl. ..... 19/108; 19/98; 19/106 R; 19/109

(58) Field of Search ..... 19/65 A, 98, 105, 19/106 R, 108, 109, 112, 296

(56) References Cited

U.S. PATENT DOCUMENTS

| | | | | |
|---|---|---|---|---|
| 2,464,425 | * | 3/1949 | White | 19/109 |
| 2,823,423 | * | 2/1958 | Suzuki | 19/109 |
| 3,145,428 | * | 8/1964 | Reiterer | 19/106 R |
| 3,235,911 | | 2/1966 | Reiterer . | |
| 4,274,178 | * | 6/1981 | Hotta | 19/106 R |
| 4,332,058 | * | 6/1982 | Warnock | 19/106 R |

FOREIGN PATENT DOCUMENTS

| | | |
|---|---|---|
| 901 035 | 1/1954 | (DE) . |
| 852 207 | 1/1940 | (FR) . |
| 1 586 479 | 3/1981 | (GB) . |

OTHER PUBLICATIONS

Patent Abstracts of Japan, vol. 013, No. 024 (C–561), Jan. 19, 1989, JP 63 227816, Sep. 22, 1988.
U.S. application No. 09/478,404, filed Jan. 6, 2000, pending.
U.S. application No. 09/579,132, May 30, 2000, pending.

* cited by examiner

*Primary Examiner*—John J. Calvert
*Assistant Examiner*—Gary L. Welch
(74) *Attorney, Agent, or Firm*—Oblon, Spivak, McClelland, Maier & Neustadt, P.C.

(57) ABSTRACT

Device and process for cleaning web-squeezing rollers (5, 6) at output from a carding machine, and their scraper blades (17), in which the said blades are mounted so that they can move tangentially away from and up to the web-squeezing rollers (5, 6) and are equipped with nozzles (29) for blowing fluid into the gaps between the blades (17) and the rollers (5, 6) for removal of the material that accumulates in the said gaps.

8 Claims, 5 Drawing Sheets

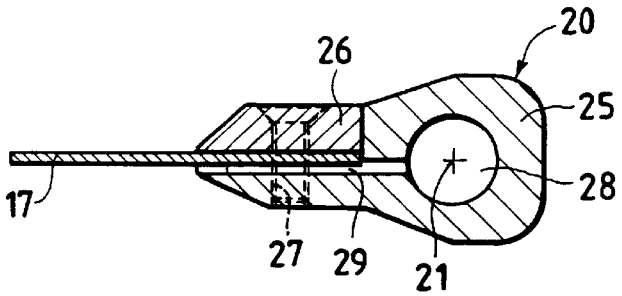
Fig.4
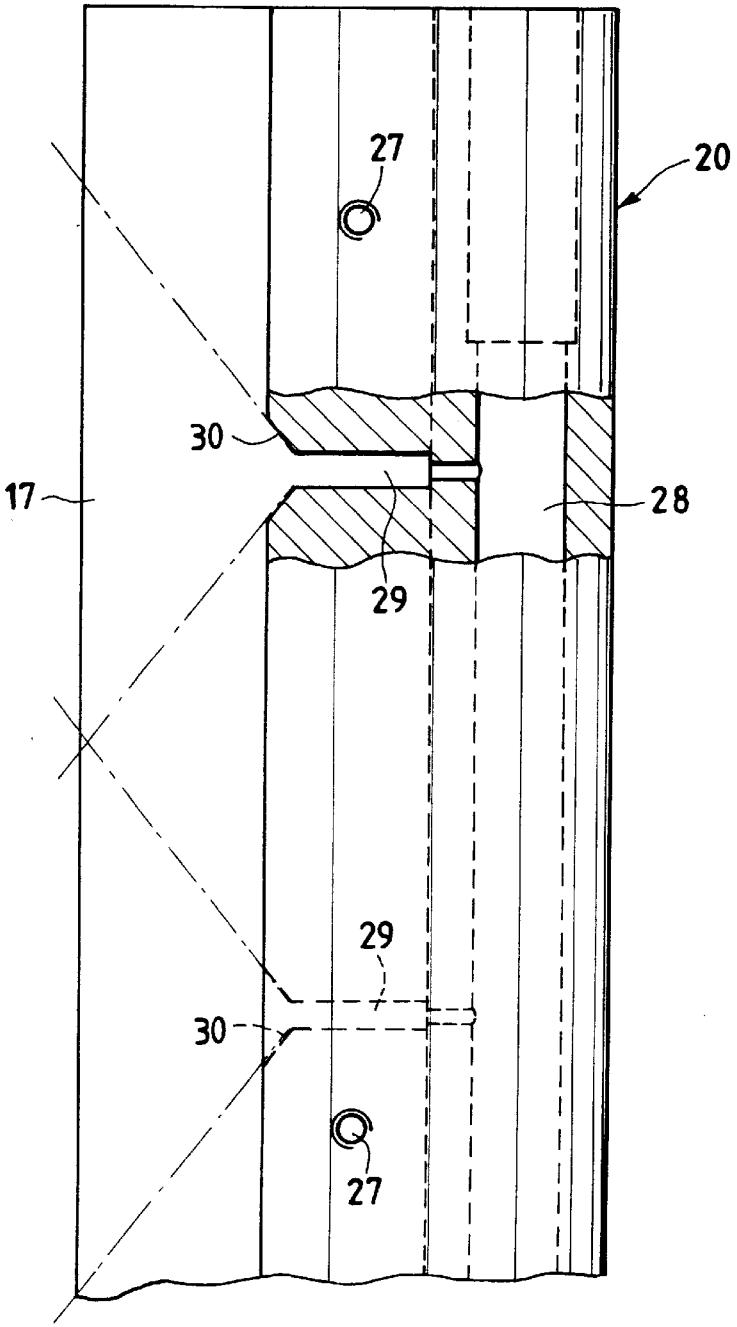

DEVICE AND PROCESS FOR CLEANING WEB-SQUEEZING ROLLERS AT OUTPUT FROM A CARDING MACHINE

BACKGROUND OF THE INVENTION

The present invention refers to machines for carding textile fibres in which staple fibres are processed so as to produce a web of fibres. During the operation, the fibres are cleaned, stretched out flat, and set parallel to one another in a thin web on the cloth of the carding drum, from which the fibre web is then removed by a rotating cylinder, normally called doffer, provided with a card cloth, and is then passed from a further cylinder, or stripper, to a compacting assembly and a drawing assembly to produce a ribbon of fibres.

In particular, the present invention regards the operation in which the web, which has been removed from the carding drum by the doffer, is then taken up by the stripper and delivered downstream to a controlled assembly for condensing the web into a ribbon and drawing it. This operation is the subject of the copending U.S. patent application No. 09/478,404, dated Jan. 6, 2000 in the name of the present applicant.

For a clearer illustration of the technical aspects and of the problems involved in the taking the web off the carding machine, reference is made to a diagram of the sequence which involves the carding drum, the doffer, the stripper and the compacter, which presented in FIG. 1 in a schematic side view corresponding to the device described in the co-pending patent application, to which the reader is referred for further details as regards the operation and structure of the said device.

Downstream of the main carding drum 1, the doffer of the carding machine is designated by 2; on the latter the fibre web 3 is taken to the stripper 4 and conveyed to the compacting assembly made up of a pair of web-squeezing cylinders 5, 6, which are smooth, rotating and have a substantially horizontal axis; these compact the web 3, the transverse dimension of which still corresponds to that of the carding drum, and pass it on to a subsequent belt conveyor 7 with a vertical working surface, which condenses the web into a ribbon. The compacting assembly works at a speed that is consistent with that of the web 3 coming from the stripper 4. The two web-squeezing cylinders 5 and 6 are driven so that they turn with one and the same linear speed, thus preventing them from sliding and rubbing against one another. The drawn ribbon is then sent on to be collected in a vessel for further processing. Above the stripper 4 is set a device consisting of a rotating brush 8 for cleaning the stripper card cloth. The doffer is contained in the apron 9 made up of containment plates. Underneath the stripper 4 is set a transverse bar 11 for supporting the web 3 that has been stripped by the stripper 4.

Underneath the stripper 4, bar 11 and bottom web-squeezing cylinder 6, is set a suction assembly 12 comprising a funnel-shaped connecting element 14 which is as wide as the generatrix of the doffer 2 and which connects the space 15 beneath the web 3, which extends from the bar 11 to the web-squeezing cylinders 5 and 6, to a suction duct 16 connected to the common aspiration system of the carding machine.

The space 15 is delimited by the scraper blades 17, which are elastically pressed and constantly held so that they adhere and are tangential to the web-squeezing cylinders throughout their width.

A further cleaning treatment of the web 3 upon removal of the latter by means of the stripper 4 is carried out when the web 3 passes from the stripper to the two web-squeezing cylinders 5, 6, which are set immediately downstream of the stripper, by aspirating from the web 3 the impurities, which are also released owing to a the concurrent effect of the web being to a certain extent drawn during its passage through the cylinders, as is described and claimed in the copending patent application cited previously.

FIG. 2 shows a perspective view of a section of the assembly for removing the web from the doffer 2, with the corresponding guards or containment plates all around.

The technical problem regards the web-squeezing rollers 5, 6 and their blades 17. The web-squeezing rollers 5, 6 have the function of conveying and compressing the fibres—including their impurities, for example husks, which are still englobed in them—and may separate the web, causing local cuts, and generate irregularities in the final ribbon which is obtained from condensing of the web, or may even cause tearing of the web and arrest of the machine. The fibres and impurities that undesirably fail to follow the detachment the web 3—which proceeds towards the condensing assembly 7—, and that, instead, remain adherent to the web-squeezing rollers 5 and 6, climb up towards the edge of their scraper blade and tend to work their way into the gap between the inner face of the blade 17 and the surface of the web-squeezing roller, thus adhering even more to the roller.

In order to maintain good operation of the surfaces of the web-squeezing rollers, in the known art the solution is adopted of making, on the said surfaces, spiral-shaped grooves 19 with one or more starts, which, in conjunction with the tangential blades 17, hinder the undesired winding of the fibres. This technical solution makes it possible to reduce winding of the fibres on the rollers but presents the drawback that in the gap between the said blades and the surfaces of the rollers 5, 6 there is an accumulation of material and that on the face of each blade coming into contact with a roller there is an accumulation of material against the edge of the blade and consequent dirtying of the inner face of the latter; this, in turn pushes the blades away from the rollers and is a further cause of the poor cleanliness of the rollers themselves and of a recirculation of fibres in the web. The aforesaid dirtying of the scraper blades 17 and of the web-squeezing rollers 5, 6 calls for periodic manual maintenance operations with the machine not running which must be carried out by qualified staff. The quality of the ribbon produced depends, as a general rule, directly on the frequency of such operations. On the other hand, a high frequency of maintenance operations has an adverse effect on machine output, in so far as the operations require stoppage of the machine and decrease its output factor.

SUMMARY OF THE INVENTION

The device and the corresponding process for cleaning the elastic blades 17 and the web-squeezing rollers 5, 6 according to the present invention perform the function of keeping both the said blades and the corresponding rollers clean, so eliminating, or at least considerably reducing, the need for manual intervention and for stoppages of the carding process, without jeopardizing the quality of the finished ribbon. The maintenance of cleanliness of the rollers and of the blades moreover makes possible a better air-tightness as regards the space 15 and a better cleaning of the web.

The invention is described in what follows with reference to a typical embodiment, which is illustrated in FIGS. 3 to 5, merely to provide a non-limiting example and to highlight further the characteristics and advantages of the present invention, with reference to the annexed schematic drawings, in which:

BRIEF DESCRIPTION OF THE DRAWINGS

FIG. 4 shows details in cross-sectional view and in top view of the embodiment of the support for the blades 17.

DETAILED DESCRIPTION

Figure 1:
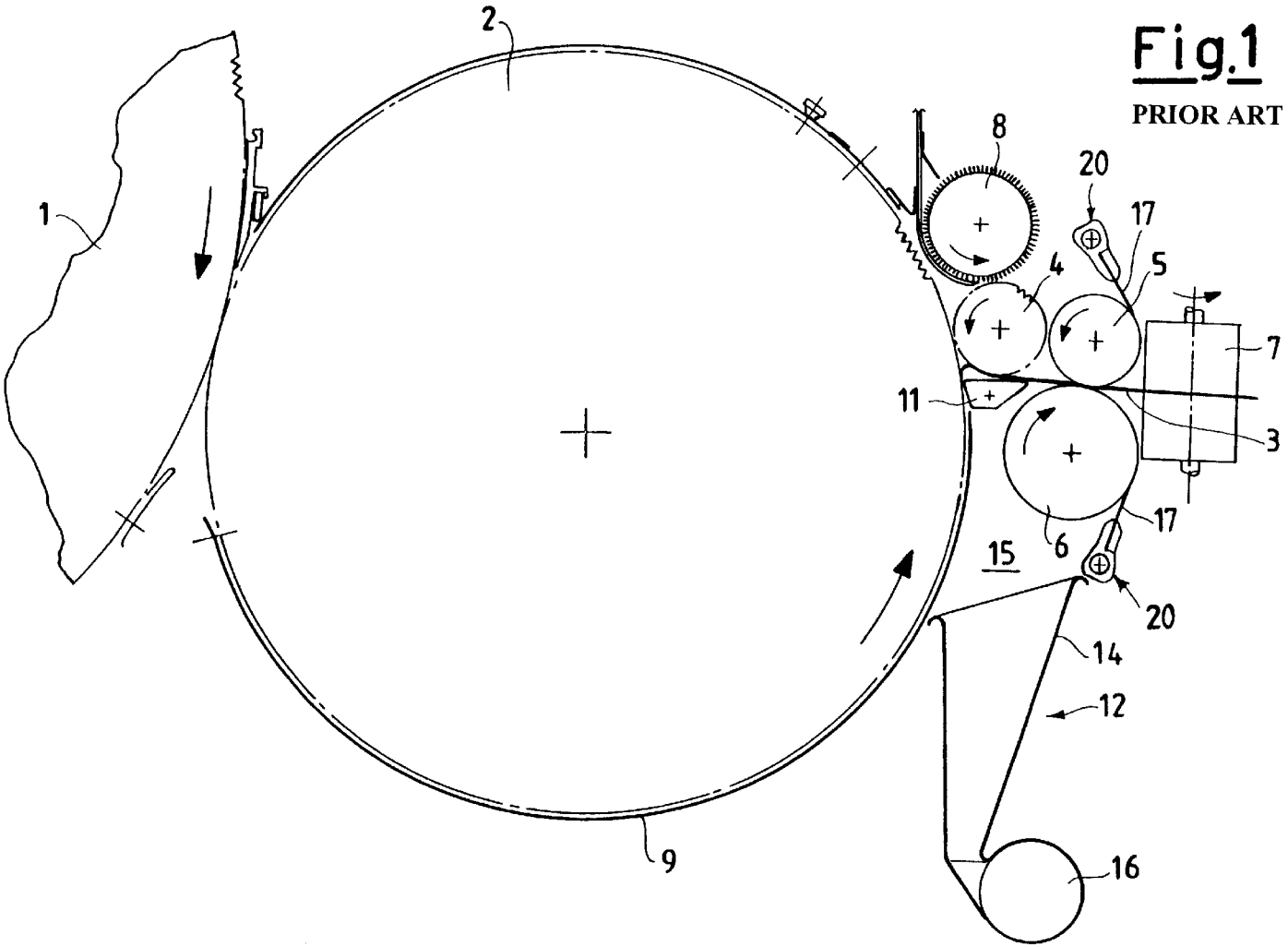
Fig.1 PRIOR ART
FIGS. 1 and 2 illustrate the technical problem in general.
Figure 2:
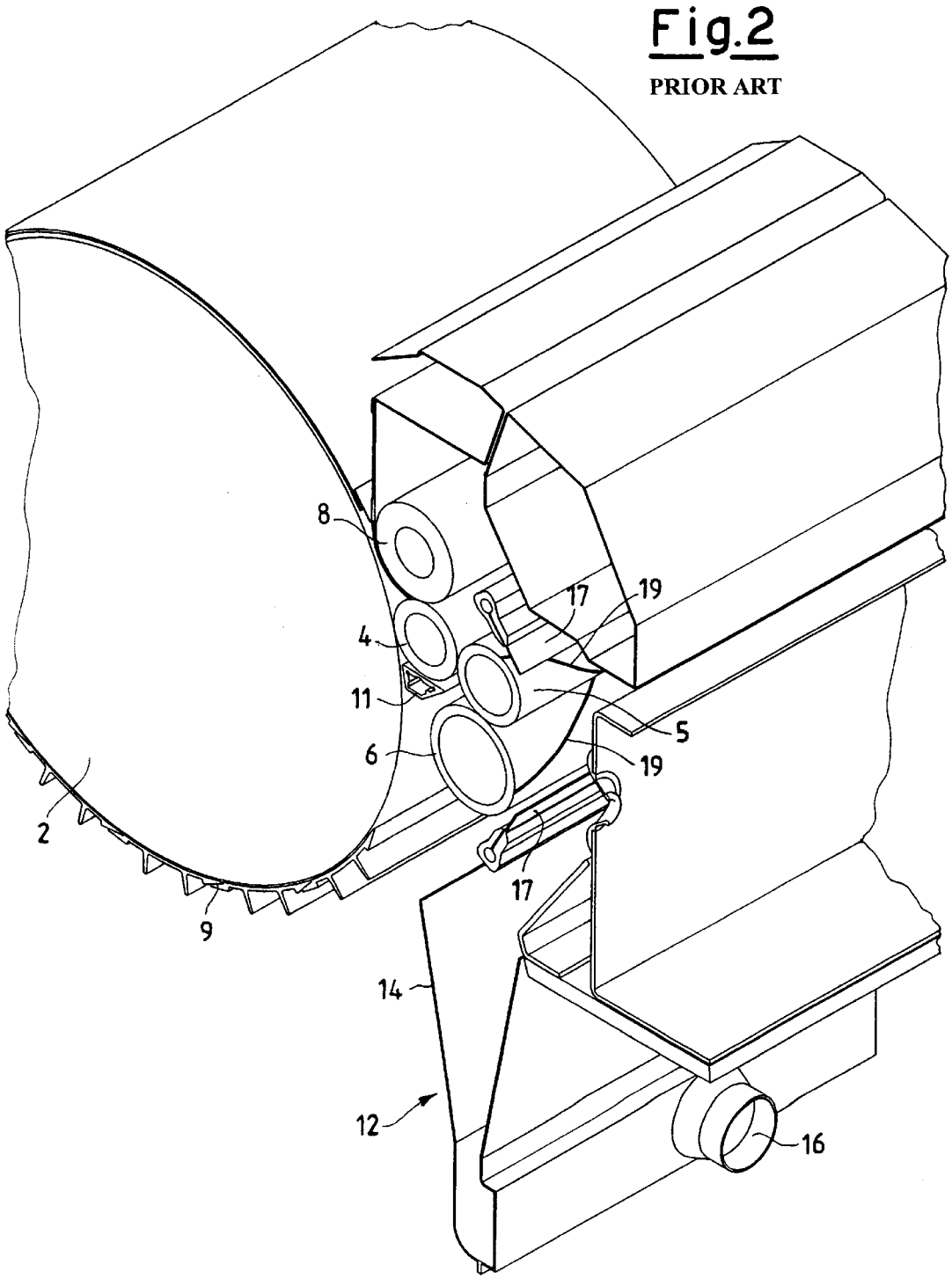
Fig.2 PRIOR ART
Figure 3:
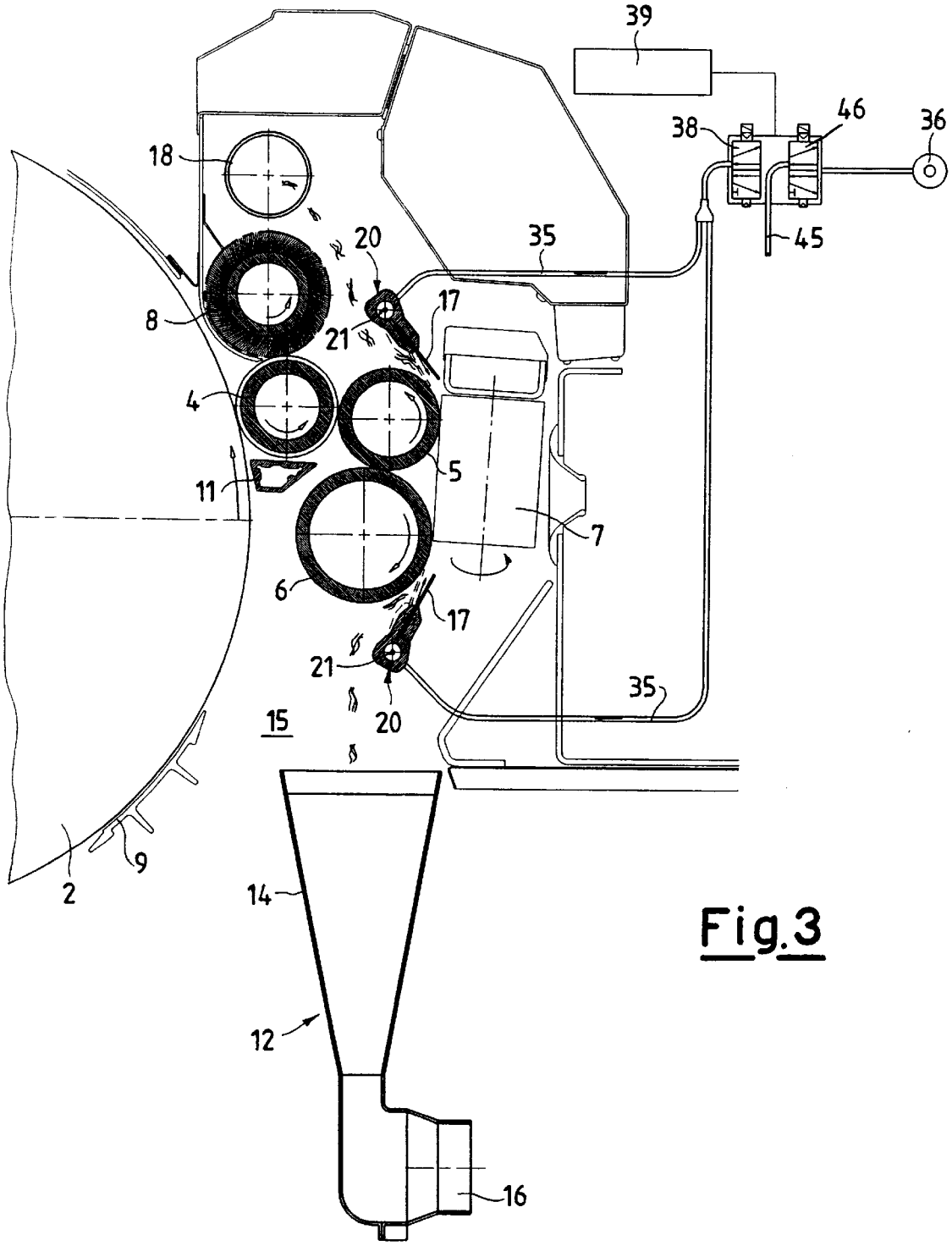
FIG. 3 shows a diagram of the cleaning device in a side view.

With reference to FIG. 3, an embodiment of the invention is shown in which the two blades 17, which correspond to the two web-squeezing rollers 5 and 6, are mounted on mobile supports 20, which are illustrated in greater detail later with reference to FIGS. 4 and 5. The said supports 20 can move between one position in which their blade 17 is set tangentially up against the respective web-squeezing roller, and one position in which the blade is moved away from its roller, so as to open up a gap between the said parts. In the embodiment of FIG. 3, this movement of each support 20 is a rotary movement about a central axis 21 of each support. In principle, the said movement of the support 20 could also be obtained by translation instead of by rotation. A supplementary suction mouth 18 is set above the doffing assembly of the doffer 2 and in the vicinity of the brush 8. Both the support 20 and its blade 17 have a length corresponding to the width of the web-squeezing roller on which they operate. In each support 20, and on the side adjacent to the web-squeezing roller, nozzles are made to blow a fluid into the gap between the blade 17 and the roller 5, 6, which are more clearly illustrated in FIG. 4.

The support 20 consists of a base bar 25 and a plate 26 set against it (see FIG. 4) which has a length corresponding to the width of the web-squeezing roller. Between the base bar 25 and the plate 26, the scraper blade 17 is clamped and fixed. The scraper blade 17 is in general made of an elastomer material containing various additives to bestow on it the characteristics desired for the purpose for which it is designed. In the embodiment of FIG. 4, this fixing is obtained, just to provide an example, with screws that engage in threaded holes 27. This type of support enables adjustment of the position of the blades 17 and easy replacement of the said blades.

In the body of the bar 25 is made a longitudinal duct 28 for distribution of the service fluid to be blown into the gap between the blades 17 and the web-squeezing rollers or cylinders 5, 6, for example compressed air. The said duct 28 connects up to a plurality of transverse nozzles 29 which have their outlets tangential to the blade 17 in the gap between the blade and the roller. The nozzles 29 are preferably made so as to distribute the outflow and to cover with their jets of air substantially the entire length of the blade, or rather of the gap between the blade and the web-squeezing roller, for removal of the material that accumulates in the area of contact between the blade and the roller, for example by means of fanned-out outlets 30 or by dividing up the outlets into a plurality of diverging holes.

With reference to FIG. 3, each of the supports 20 is connected to a supply pipe 35 for supplying compressed air, which is connected, via the manifold 36, to the machine compressed-air system. The flow of compressed air to the supports 20 is distributed by the solenoid valve 38 controlled by the machine control unit 39.

Figure 5B:
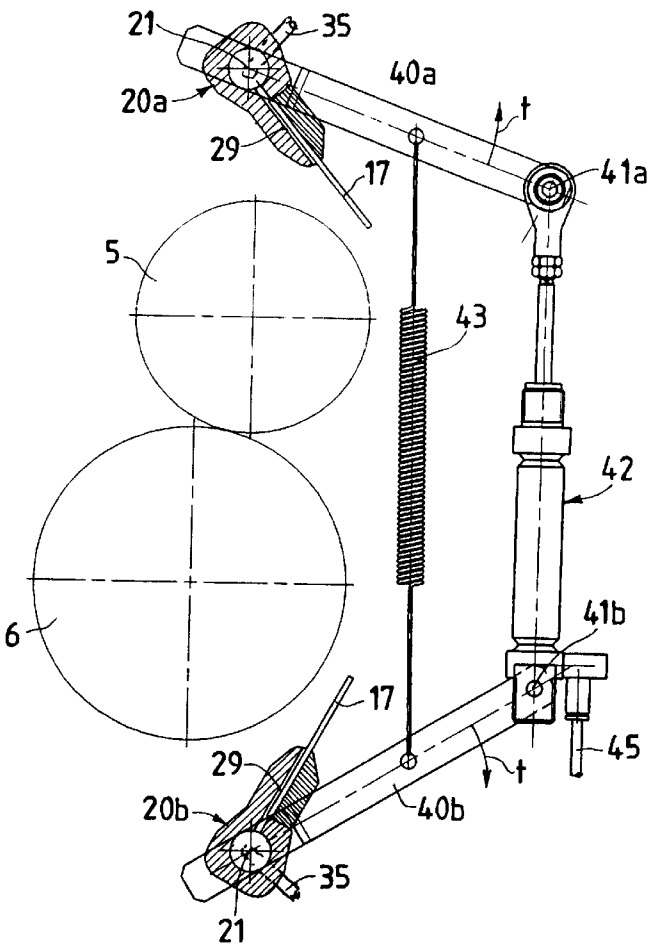
FIGS. 5A and 5B show a diagram of how the blades 17 move with respect to the web-squeezing rollers 5 and 6.
Figure 5A:
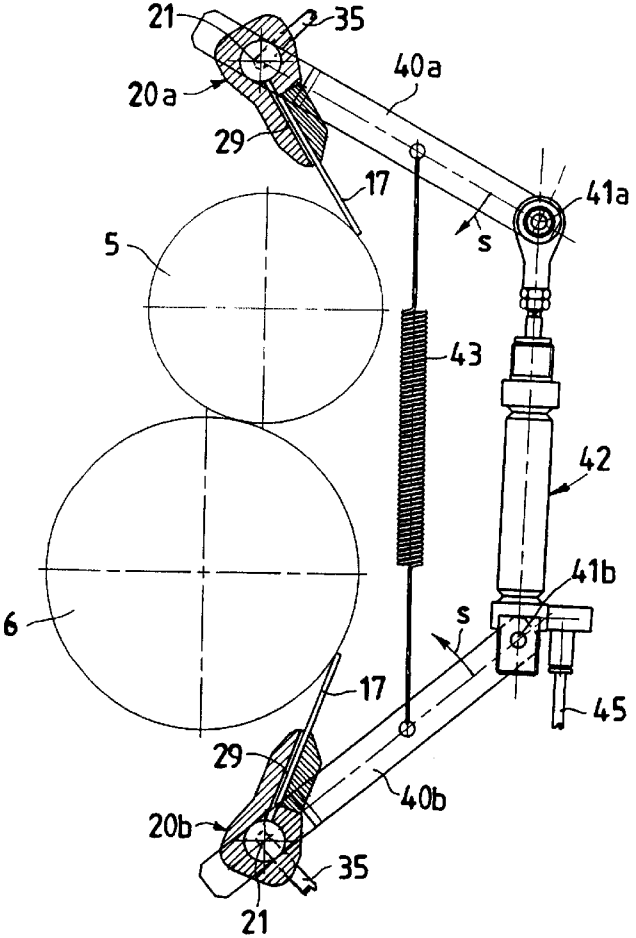

FIGS. 5A and 5B illustrate an example of embodiment of the device for moving the supports 20 and the blades 17, with a rotary motion of the supports 20 about their axes 21. In FIG. 5A, the blades 17 and their supports 20 are in the position where they are brought up against the web-squeezing rollers 5,6; in FIG. 5B, instead, they are in the position where they are moved away. If we add the letter "a" to the numbers of the parts that are in the top position, and the letter "b" to the numbers of the parts that are in the bottom position, the two supports 20*a*, 20*b* are mounted rigidly on two bars 40*a*, 40*b*, which are hinged to the structure of the machine and are able to rotate in the direction of the arrows "s" of rotation when the blades come up close to their rollers, and in the direction of the arrows "t" of rotation when the blades move away from their rollers.

At their opposite ends, to the two bars 40*a*, 40*b* are connected, by means of pins 41*a* and 41*b*, the ends of a single-acting pneumatic cylinder 42, which in this way can open up or close, thus setting further apart or bringing nearer the said ends of the bars 40. A tension spring 43 is set between the said bars 40*a*, 40*b*, the said tension spring being connected at an intermediate point along each bar 40*a*, 40*b*. The spring 43 tends to draw the said bars closer together in the direction of to the rotation "s", to bring the blades 17 up against their web-squeezing rollers 5, 6, as well as causing the pneumatic cylinder 42 to retract, as shown in FIG. 5A. When the pneumatic cylinder 42 is supplied with compressed air, sent via the pipe 45, the bars 40 rotate in the direction of the arrows "t", and the blades 17 move away from the rollers 5, 6. As indicated in the diagram of FIG. 3, the pipe 45 is shut or opened by means of the solenoid valve 46, in all cases upon a command from the machine control unit 39. The two solenoid valves 38, 46 are governed by the control unit 39 according to pre-set cleaning cycles.

As illustrated in FIG. 5B, supply of compressed air to the pneumatic cylinder 42 from the pipe 45 causes the said cylinder to expand and its stem to come out, thus increasing the distance between the ends 41*a* and 41*b* and causing the rotation "t", so that the blades 17 move away from their web-squeezing rollers 5, 6 and the spring 43 is stretched. When the air is bled off from the cylinder 42 by means of a valve which is not shown in the figure for reasons of simplicity, the tension of the spring restores the situation of FIG. 5A, bringing the two blades 17 back up close to the web-squeezing rollers 5, 6 and rotating the bars 40 in the direction of the arrows "s", so that the gap that was created for the cleaning operations is now closed again. The use of a double-acting pneumatic cylinder represents a possible alternative embodiment.

The process for cleaning the blades 17 and the gap between the blades 17 and the web-squeezing rollers 5, 6 is preferably carried out without interrupting normal operation of the machine, according to working cycles which combine the action of blowing compressed air through the nozzles 29 with the movement of the blades 17 towards and away from their rollers. The blowing of air may be intermittent or continuous, according to whether the aim is to obtain a pulsating effect or a moderated and continuous effect.

For example, a cleaning cycle can be initiated, with the blades 17 not yet brought up close to the rollers, by blowing compressed air from the nozzles 29 for a few seconds. Then the blowing is stopped, and the blades 17 are moved away from and up to the rollers 5, 6 a number of times, by sending the stem 48 of the cylinder 42 in and out a number of times. In this phase, a cleaning action is obtained as a result of the current of air generated by the rotation of the web-squeezing rollers, which removes the fibres that are still lying astride the edges of the blades 17. Another cycle may reverse the order of the operations of the cycle previously described, i.e., by first moving the blades away from the cylinders and by then starting blowing.

As a general rule, the said cleaning cycles are organized in phases lasting a few seconds, an entire cycle not exceeding one minute, and hence do not interfere with the normal carding process. According to the material being processed, the said cleaning cycles can be repeated with more or less frequency without any problems in terms of machine output.

What is claimed is:

1. Device for the removal and cleaning of a web (3) produced by a carding machine, the web (3) being removed from a cloth-covered surface of a doffer (2) by a stripper cylinder (4), being conveyed to a compacting assembly consisting of a pair of web-squeezing cylinders or rollers (5, 6) which are subjected to the action of scraper blades (17) to maintain the said web-squeezing rollers free from possible windings of fibres, the said device being characterized in that the scraper blades (17) are set on supporting elements (20) for movement of said scraper blades tangentially away from and alternatively close to the web-squeezing rollers (5, 6) during normal operation of the carding machine, the supports (20) being provided with a plurality of nozzles (29) for blowing compressed air or other fluid into gaps between the blades (17) and the rollers (5, 6) for removal of the material that accumulates at the point of contact between the blades and the rollers.

2. Device for the removal and cleaning of the web (3) produced by a carding machine according to claim 1, characterized in that in the support (20) is made a duct (28) for the distribution of the fluid to be blown, which connects up to a plurality of nozzles (29) having their outlets set tangentially to the blade (17).

3. Device for the removal and cleaning of the web (3) produced by a carding machine according to claim 2, characterized in that the nozzles (29) are made with fanned-out outlets (30) so as to cover with their air jets substantially the entire length of the blade (17) and the gap between the blade (17) and the web-squeezing rollers (5, 6).

4. Device for the removal and cleaning of the web (3) produced by a carding machine according to claim 1, characterized in that the supports **(20*a*, 20*b*) are mounted rigidly on two bars (40*a*, 40*b*), which are hinged to a structure of the machine and are able to rotate so as to bring the blades up against or move them away from their rollers, each bar (40*a*, 40*b*) having opposite ends connected to an end of a pneumatic cylinder (42), which can open up or close, thus moving the said ends of the bars (40)** away from or towards one another.

5. Device for the removal and cleaning of the web (3) produced by a carding machine according to claim 4, characterized in that the pneumatic cylinder (42) is a single-acting cylinder, and in that a tension spring (43) is set between the said bars **(40*a*, 40*b*)**, which tends to pull the said bars towards one another.

6. Device for the removal and cleaning of the web (3) produced by a carding machine according to claim 4, characterized in that the supports (20) and the pneumatic cylinder (42) are supplied, respectively, via pipes (35) and (45) and via solenoid valves (38, 46) governed by a machine control unit (39) according to pre-set cleaning cycles.

7. A process for the removal and cleaning of a web produced by a carding machine comprising the steps of:

removing the web from the carding machine with a cloth-covered doffer, removing the web from the doffer with a stripper cylinder, conveying the web from the stripper cylinder to a compacting assembly consisting of a pair of web-squeezing cylinders or rollers, cleaning the web-squeezing cylinders or rollers with scraper blades and a plurality of nozzles attached to supporting elements by moving the scraper blades tangentially away from and alternatively close to the web-squeezing cylinders or rollers and by blowing compressed air or other fluid through the nozzles and into gaps formed between the scraper blades and the web-squeezing cylinders or rollers without interrupting normal machine operations.

8. A process for the removal and cleaning of a web produced by a carding machine according to claim 7 wherein the compressed air or other fluid is intermittently blown into said gaps as the scraper blades are repeatedly moved away and close to the web-squeezing cylinders or rollers.

* * * * *